US007470332B2

(12) United States Patent
Ishihara et al.

(10) Patent No.: US 7,470,332 B2
(45) Date of Patent: Dec. 30, 2008

(54) PRODUCTION METHOD FOR SOFT MAGNETIC SINTERED MEMBER

(75) Inventors: Chio Ishihara, Matsudo (JP); Kazuo Asaka, Matsudo (JP)

(73) Assignee: Hitachi Powdered Metals Co., Ltd., Matsudo (JP)

( * ) Notice: Subject to any disclaimer, the term of this patent is extended or adjusted under 35 U.S.C. 154(b) by 130 days.

(21) Appl. No.: 10/594,223

(22) PCT Filed: Mar. 29, 2005

(86) PCT No.: PCT/JP2005/005813

§ 371 (c)(1),
(2), (4) Date: Sep. 25, 2006

(87) PCT Pub. No.: WO2005/093111

PCT Pub. Date: Oct. 6, 2005

(65) Prior Publication Data

US 2007/0196231 A1 Aug. 23, 2007

(30) Foreign Application Priority Data

Mar. 29, 2004 (JP) ..... 2004-094250

(51) Int. Cl.
*H01F 1/147* (2006.01)

(52) U.S. Cl. ..... 148/104; 419/23; 419/38

(58) Field of Classification Search ..... None
See application file for complete search history.

(56) References Cited

U.S. PATENT DOCUMENTS

| | | | | |
|---|---|---|---|---|
| 4,705,581 | A | 11/1987 | Honkura et al. | |
| 4,956,011 | A | 9/1990 | Nishida et al. | |
| 5,207,841 | A * | 5/1993 | Shigeta et al. | 148/307 |
| 5,443,787 | A | 8/1995 | Mori et al. | |
| 6,126,894 | A * | 10/2000 | Moxson | 419/2 |
| 2004/0161600 | A1 * | 8/2004 | Igarashi et al. | 428/328 |

FOREIGN PATENT DOCUMENTS

| | | |
|---|---|---|
| JP | A 55-113803 | 9/1980 |
| JP | A 62-027545 | 2/1987 |
| JP | A 63-014838 | 1/1988 |
| JP | A 7-179983 | 7/1995 |
| JP | A 2002-275600 | 9/2002 |

* cited by examiner

*Primary Examiner*—John P. Sheehan
(74) *Attorney, Agent, or Firm*—Oliff & Berridge, PLC

(57) ABSTRACT

A soft magnetic sintered member having uniform dispersion of alloy elements and a production method for the same at low cost are provided. The soft magnetic sintered member consists of, all in mass %, 2.9 to 7% of Cr; 1.5 to 6.88% of Si; and the balance of Fe and inevitable impurities. The production method for a soft magnetic sintered member includes: preparing an Fe alloy powder consisting of 3 to 7 mass % of Cr, 1.5 to 3.5 mass % of Si, and the balance of Fe and inevitable impurities; or a mixed powder in which the Fe alloy powder is mixed with an Si powder having an average particle size of 1 to 45 μm. The production method further includes: compacting the Fe alloy powder or the mixed powder into a green compact having a predetermined shape; and sintering the green compact.

6 Claims, No Drawings

PRODUCTION METHOD FOR SOFT MAGNETIC SINTERED MEMBER

TECHNICAL FIELD

The present invention relates to soft magnetic sintered member and production methods therefor, and in particular, relates to such techniques which are suitable for members such as plungers of solenoid valves in electronic fuel injection devices for automobiles, hydraulic apparatuses, and various kinds of machining apparatuses, and members such as various kinds of actuators, required to have corrosion resistance and strength as well as alternating current magnetic properties.

BACKGROUND ART

Recently, electronic control fuel injection devices have been increasingly installed as fuel supplying devices, instead of conventional carburetors, in accordance with requirements for emission control and reduced fuel consumption. Plungers of solenoid valves in such electronically controlled fuel injection devices, hydraulic apparatuses, and various kinds of machining apparatuses are essentially required to have high alternating-current magnetic properties for responsiveness, strength (wear resistance) for resisting frequent impacts with a partner member, and corrosion resistance in the environment. Magnetic members for automobiles are also essentially required to have stable magnetic properties in a temperature range from about −40 to 200° C. which are encountered in practice in the environment.

Soft magnetic stainless steels have been used as materials for magnetic members in the above fuel injection devices and the like, since corrosion resistance and magnetic properties are important, and the members have been manufactured by mechanical forming method such as plastic working and machining methods, as shown in Japanese Examined Patent Application Publication No. 5-10419. However, the magnetic members such as electronic fuel injection valves for automobiles have complicated shape and are required to have high dimensional accuracy, whereby machinability, corrosion resistance and magnetic properties cannot be simultaneously improved together, and the manufacturing costs are high.

In order to solve the above problems, Japanese Unexamined Patent Application Publications Nos. 7-179983 and 2002-275600 propose production methods using powder metallurgy methods. Japanese Unexamined Patent Application Publication No. 7-179983 discloses a production method for soft magnetic sintered material in which a mixed powder of an Fe—Cr alloy powder, an Fe—Si alloy powder, and an Fe powder and mixed powder of an Fe—Cr—Si powder and an Fe powder are compacted and sintered. Japanese Unexamined Patent Application Publication No. 2002-275600 discloses the use of a powder as a raw material made by granulating a fine stainless steel powder and a fine Si powder or a fine Fe—Si powder.

DISCLOSURE OF THE INVENTION

However, in the soft magnetic sintered material according to Japanese Unexamined Patent Application Publication No. 7-179983, since a powder containing an alloy element and a powder not containing an alloy powder (Fe powder) are mixed, the dispersion of the alloy element is not uniform in the material after sintering. As a result, the magnetic properties of the material are easily not uniform. Specifically, when dispersion of Si is not uniform, specific resistance of the material is not stable and iron loss increases, and responsiveness is deteriorated when the material is used for actuators since permeability of the material is not stable. Furthermore, corrosion resistance and strength are not uniform in portions of the materials, and overall corrosion resistance and strength are decreased. In the soft magnetic sintered material according to Japanese Unexamined Patent Application Publication No. 2002-275600, dispersion of alloy elements is uniform since fine powder is used, whereby some properties such as magnetic properties, strength, and corrosion resistance are improved. However, in the technique, production costs are high since commercial fine powder which is expensive is used and a granulation step is required.

Therefore, an object of the invention is to provide a soft magnetic sintered member having uniform dispersion of alloy elements and a production method for the same at low cost.

The present invention has been made to achieve the above object. In the soft magnetic sintered member of the present invention, amount of Cr is essentially restricted to the lowest content in which corrosion resistance is maintained to increase space factor of Fe, thereby increasing magnetic properties. Furthermore, Si is essentially contained, thereby improving electrical resistance and strength and stabilizing magnetic properties in practical environmental temperatures. More specifically, the present invention provides a soft magnetic sintered member consisting of, in all mass %, 2.9 to 7% of Cr; 1.5 to 6.88% of Si; and balance of Fe and inevitable impurities.

According to the first production method for soft magnetic sintered member of the present invention, an Fe—Cr alloy powder solid-solved with Cr is essentially added with Si up to the amount of which compressibility is maintained. More specifically, an Fe alloy powder consisting of 3 to 7 mass % of Cr, 1.5 to 3.5 mass % of Si, and balance of Fe and inevitable impurities is used.

According to the second production method for a soft magnetic sintered member of the present invention, the above Fe alloy powder is used and an additional amount of Si is essentially added by a fine Si powder, thereby containing a large amount of Si. More specifically, in the second production method for soft magnetic sintered member of the invention, an Fe alloy powder consisting of 3 to 7 mass % of Cr, 1.5 to 3.5 mass % of Si, and the balance of Fe and inevitable impurities is used and a fine Si powder is added thereto at an amount of 0.1 to 3.5 mass %. Thus, the mixed powder is used.

In the second production method for a soft magnetic sintered member of the invention, a dry-mixed powder may be used for the mixed powder. The mixed powder is preferably obtained by immersing the Fe alloy powder into a dispersion liquid in which the Si powder is dispersed in water or ethanol, or spraying the dispersion liquid to the Fe alloy powder, then drying the Fe alloy powder. A binder is preferably mixed to the dispersion liquid at a rate of 1 mass % or less with respect to 100 mass % of the mixed powder. Such processes for preparing the mixed powder are advantageously simple.

However, the invention is not limited to the above method, and can be applied with conventional method in which a fine Si powder is adhered to the surface of the Fe alloy powder via binder.

The soft magnetic sintered member is characterized by consisting of, all in mass %, 2.9 to 7% of Cr; 1.5 to 6.88% of Si; and the balance of Fe and inevitable impurities, whereby amount of Cr is essentially restricted to the lowest content in which corrosion resistance is maintained to increase space factor of Fe, thereby containing suitable corrosion resistance and superior magnetic properties. The production method for a soft magnetic sintered member of the present invention is characterized by using an Fe alloy powder consisting of 3 to 7 mass % of Cr, 1.5 to 3.5 mass % of Si, and balance of Fe and inevitable impurities, or in a case in which there is an increased amount of Si, adding a fine Si powder to the Fe alloy powder at an amount of 0.1 to 3.5 mass %, thereby using the mixed powder. In the production method of the invention, dispersion of the alloy elements in the soft magnetic sintered member is uniform, and manufacturing cost can be low since fine powder is not used and a granulation step is not required.

BEST MODE FOR CARRYING OUT THE INVENTION

An embodiment of the invention will be explained hereinafter.

The reason of the numerical limitation regarding amounts of elements and particle sizes of the invention are described below.

Cr improves electrical resistance and is an indispensable element for improving corrosion resistance. Cr is easily oxidized and improves corrosion resistance by forming a secure oxide film on the surface of a member, and such an effect is not sufficient when the Cr amount is less than 3 mass %. On the other hand, although corrosion resistance is improved as the Cr amount is increased, flux density is decreased since the amount of Fe is decreased in the view of magnetic properties. When the Cr amount is more than 7 mass %, flux density is greatly decreased. Therefore, the upper limit of Cr is set to 7 mass %.

Si improves electrical resistance, decreases iron loss by decreasing eddy-current loss, increases magnetic permeability by making crystal grain coarse, and inhibits variation of magnetic properties according to environment temperature. Furthermore, Si strengthens the Fe matrix and improves resistance against frequent impacts with a partner member. These effects are not sufficiently obtained when the amount of Si is less than 1.5 mass %. Therefore, the lower limit of the Si amount is set to 1.5 mass %. Si is preferably added by solid solution into the Fe alloy powder or by adhering to the Fe powder by partial diffusion for uniform dispersion of the alloy element and easy handling of the powder. When amount of Si is solid-solved into the Fe alloy powder, the powder is hard and compressibility is deteriorated. Therefore, the upper limit of the Si amount is 3.5 mass %.

Thus, in the first production method for a soft magnetic sintered member of the invention, the Fe alloy powder consisting of 3 to 7 mass % of Cr, 1.5 to 3.5 mass % of Si, and balance of Fe and inevitable impurities is used. It should be noted that Si solid-solves into the Fe matrix and disadvantageously hardens the Fe matrix. In this case, the Fe alloy powder can be given with sufficient compressibility by performing a heat treatment to the Fe alloy powder as explained hereinafter.

If the above effects of Si are further required, a fine Si powder may be added to the above Fe alloy powder. If Si is added by the fine Si powder, Si in the soft magnetic sintered member is uniformly dispersed. In this case, when the amount of the fine Si powder is less than 0.1 mass %, the above effect cannot be sufficiently obtained. When the amount of the fine Si powder is more than 3.5 mass %, amount of the fine powder in the mixed powder is large, whereby flowability and compressibility of the powder are deteriorated. Therefore, in the second production method for soft magnetic sintered member of the invention, the Fe alloy powder consisting of 3 to 7 mass % of Cr, 1.5 to 3.5 mass % of Si, and the balance of Fe and inevitable impurities is used and a fine Si powder is added thereto at an amount of 0.1 to 3.5 mass %. Thus, the mixed powder is used.

The soft magnetic sintered member yielded by the first production method for soft magnetic sintered member of the invention consists of 3 to 7 mass % of Cr, 1.5 to 3.5 mass % of Si, and the balance of Fe and inevitable impurities, and uniformly disperses the alloy elements throughout. The soft magnetic sintered member yielded by the second production method for soft magnetic sintered member of the invention consists of 2.9 to 6.99 mass % of Cr, 1.6 to 6.88 mass % of Si, and balance of Fe and inevitable impurities, and also uniformly disperses the alloy elements in any portions. Therefore, the entire range of the soft magnetic sintered member of the invention consists of 2.9 to 7 mass % of Cr, 1.5 to 6.88 mass % of Si, and the balance of Fe and inevitable impurities, and uniformly disperses the alloy elements throughout.

The above Fe alloy powder contains Cr and Si, which improve hardenability, whereby much cooling strain is stored in the powder in atomization. Therefore, annealing at an ordinary temperature of 400 to 600° C. after atomization is not sufficient to remove the strain, whereby the powder is not sufficiently softened and compressibility thereof is not sufficient. In such an Fe alloy powder, the cooling strain generated in atomization can be removed by annealing at just before a temperature in which diffusion of the powder starts, whereby compressibility of the powder can be greatly improved. More specifically, the Fe alloy powder may be subjected to annealing at a temperature of 600 to 800° C., more preferably at 700 to 800° C., whereby compressibility of the powder can be improved. In this case, if the annealing temperature is more than 800° C., diffusion between particles starts and particles are bonded. As a result, the powder must be subjected to disintegration, whereby work strain is applied to the powder.

In the above mixed powder, an Fe alloy powder having an average particle size of 75 to 150 μm which is an ordinary particle size for powder metallurgy and a fine Si powder having an average particle size of 1 to 45 μm may be mixed. In this case, the fine Si powder is uniformly absorbed on the surface of the Fe alloy powder with a thin thickness by van der Waals force. In the mixed powder, the Fe—Cr—Si alloy powder as a base powder is not a fine powder, flowability and compressibility are superior, and a granulation step is not required, thereby being easily applied to ordinary powder metallurgy methods. When such a mixed powder is filled into a die and compacted, and the obtained green compact is sintered, the fine Si powder uniformly absorbed on the surface of the Fe alloy powder with a thin thickness rapidly diffuses into the Fe alloy. As a result, the alloy element is uniform throughout in the sintered member, and pores do not remain at the portion where the Si powder existed.

If the average particle size of the fine Si powder is more than 45 μm, weight of the Si powder is greater than the van der Waals forces, whereby absorption of the Si powder to the Fe alloy powder is insufficient. If desorbing of Si powder increases, diffusion of the Si is not uniform and magnetic properties are not uniform. Furthermore, the Si particles agglomerate with each other in the mixed powder, so that coarse pores remain after sintering at the portion where the agglomerate Si particles existed. As a result, density of the sintered member decreases, whereby flux density is decreased. On the other hand, the Si powder of which the average particle size is less than 1 μm is expensive for industrially. Therefore, the average particle size of the Si powder is 1 to 45 μm.

The Fe alloy powder and the fine Si powder may be satisfactory mixed by ordinary dry mixing methods. As mentioned above, since a partial amount of necessary Si has been solid-solved into the Fe alloy, the amount of Si which is added by the fine powder can be small. Therefore, particles hardly agglomerate, even though in the case of simple dry mixing method, the fine Si powder is uniformly coated on the surface of the Fe alloy powder by van der Waals force.

In this case, if a more uniform coating of the fine Si powder is required, a wet mixing method may be used. That is, a dispersion liquid in which the Si powder is dispersed in water or ethanol is prepared, and the Fe alloy powder is immersed into the dispersion liquid or the dispersion liquid is sprayed to the Fe alloy powder, and then the Fe alloy powder is dried and used. In this case, the fine Si powder is more uniformly coated on the Fe alloy powder.

When the wet mixing method is applied, a binder such as PVP or PVA is preferably added to the dispersion liquid, whereby the fine Si powder is more strongly adhered to the Fe alloy powder. Enough amount of the binder is 1 mass % or less with respect to 100 mass % of the mixed powder since the adhered Si powder is fine. An excessive amount of the binder is not preferable since the time it would take for removing the binder would be long.

A dispersing agent and/or surface-active agent may be added to the dispersion liquid. When a dispersing agent is added to the dispersion liquid, the fine Si powder does not settle and uniformly disperses in the dispersion liquid. When a surface-active agent is added to the dispersion liquid, wettability between the Fe alloy powder, the fine Si powder and the dispersion liquid is improved. In both cases, the fine Si powder is more uniformly coated on the Fe alloy powder.

EMBODIMENTS

Embodiment 1

An Fe alloy powder having a particle fineness of −100 mesh and a composition shown in Table 1 was mixed with an Si powder having an average particle size of 10 μm, so that a mixed powder was obtained. The mixed powder was formed into ring-shaped green compacts with an outer diameter of 30 mm, an inner diameter of 20 mm, and a height of 5 mm at a compacting pressure of 700 MPa. The green compacts were sintered at 1200° C. for 60 minutes in a pressure-reduced gas atmosphere having a pressure of $10^{-3}$ Torr, and samples 01 to 07 having compositions shown in Table 1 were obtained. Hardness, density, wear amount, Direct Current (=DC) magnetic properties, Alternating Current (=AC) magnetic properties, electrical property, and corrosion resistance of each sample 01 to 07 were evaluated. These evaluation results are shown in Table 2. The measurement and test methods therefor are described below. The Fe alloy powders used in the Embodiments 1 to 5 were powders annealed at a temperature of 600° C.

The hardness was measured by using a Rockwell B-scale hardness. The density was measured by Archimedes' Method. Regarding the wear amount, a repeated impact test was performed such that impacts which were the same as those of a solenoid valve were applied to the samples at a speed of 60 rpm, 10 million times, the sizes of each sample before and after the repeated impact test were measured, and the difference between the measured sizes was obtained as the wear amount.

Regarding the DC magnetic properties and the AC magnetic properties, a primary coil was wound by 100 turns, a secondary coil was wound by 20 turns, and B-H curves (=magnetization curves) of DC and AC were measured at a room temperature (20° C.). Magnetic flux density $B_{2000}$ and magnetic permeability $\mu_m$ in a magnetic field of 2000 (A/m) applied to each sample were measured as the DC magnetic properties. In an excitation magnetic flux density of 0.1 T at a frequency of 1 KHz, iron loss value W (0.1 T/1 kHz) was measured as the AC property. Regarding the electrical property, a surface of each sample was polished by a # 800 abrasive paper and a specific resistance p of the polished surface was measured by the four-probe method.

Regarding the corrosion resistance, an environmental test was performed on each sample in a hot and humid environment having a temperature of 80° C. and a humidity of 90% for 100 hours, and the corrosion condition of each sample was evaluated by visual observation. The evaluation "good" indicates that "generation of corrosion was not observed", the evaluation "bad" indicates that "the corrosion was generated on approximately the entire surface", and the evaluation "almost good" indicates that "the corrosion was not generated on the entire surface but was generated on some level".

In the evaluations of the embodiments, the desired value of the wear amount was 5 μm or less, the desired value of the magnetic flux density was 1.2 T or more and the desired value of the iron loss was 10 W/kg or less in view of magnetic properties, and it is desirable that the corrosion resistance be "almost good" or "good".

TABLE 1

| Sample No. | Mixing Ratio mass % | | | | | | | | |
|---|---|---|---|---|---|---|---|---|---|
| | Fe Alloy Powder | | | | Si Powder | | | | |
| | | Powder Composition mass % | | | | Average Diameter | Overall Composition mass % | | |
| | | Fe | Cr | Si | | μm | Fe | Cr | Si |
| 01 | Balance | Balance | — | 3.00 | 0.50 | 10.00 | Balance | — | 3.49 |
| 02 | Balance | Balance | 1.50 | 3.00 | 0.50 | 10.00 | Balance | 1.49 | 3.49 |
| 03 | Balance | Balance | 3.00 | 3.00 | 0.50 | 10.00 | Balance | 2.99 | 3.49 |
| 04 | Balance | Balance | 4.00 | 3.00 | 0.50 | 10.00 | Balance | 3.98 | 3.49 |
| 05 | Balance | Balance | 6.00 | 3.00 | 0.50 | 10.00 | Balance | 5.97 | 3.49 |
| 06 | Balance | Balance | 8.00 | 3.00 | 0.50 | 10.00 | Balance | 7.96 | 3.49 |
| 07 | Balance | Balance | 10.00 | 3.00 | 0.50 | 10.00 | Balance | 9.95 | 3.49 |

TABLE 2

| Sample No. | Evaluation Item | | | | | | | |
|---|---|---|---|---|---|---|---|---|
| | Hardness HRB | Wear | | DC magnetic | | AC magnetic properties | Electrical Property properties | Specific |
| | | Amount μm | Density $Mg/m^3$ | $B_{2000}$ T | $\mu_m$ | W(0.1 T/1 kHz) W/kg | Resistance p μΩcm | Corrosion Resistance |
| 01 | 88 | 3 | 7.50 | 1.48 | 3800 | 8.5 | 115 | Bad |
| 02 | 87 | 3 | 7.45 | 1.45 | 3700 | 8.5 | 116 | Bad |
| 03 | 88 | 3 | 7.40 | 1.40 | 3600 | 8.5 | 118 | Almost Good |
| 04 | 89 | 3 | 7.35 | 1.36 | 3500 | 8.4 | 118 | Good |
| 05 | 90 | 2 | 7.30 | 1.30 | 3500 | 8.3 | 120 | Good |
| 06 | 90 | 2 | 7.26 | 1.26 | 3000 | 8.3 | 121 | Good |
| 07 | 90 | 2 | 7.15 | 1.19 | 2700 | 8.5 | 121 | Good |

As shown in Tables 1 and 2, the influence of the added Cr content in the Fe alloy powder was described below.

(1) The hardness and the wear amount were approximately constant, and they were not significantly influenced by the added Cr content in the Fe alloy powder. This is because the hardness of the matrix had already been increased by adding 3 mass % of Si.

(2) As the Cr content in the Fe alloy powder was increased, the included Fe content in the matrix was decreased, so that the density decreased, and the space factor of Fe in the matrix thereby decreased. As a result, the magnetic flux density was decreased. In particular, in the sample 07 including 8 mass % or more of Cr, the magnetic flux density was greatly decreased, and it was smaller than the desired magnetic flux density of 1.2 T.

(3) As the Cr content in the Fe alloy powder was increased, the magnetic permeability was decreased. In particular, in the sample 19 including 8 mass % or more of Cr, the magnetic permeability was smaller than the desired magnetic permeability.

(4) As the Cr content in the Fe alloy powder was increased, the specific resistance was slightly increased.

(5) The iron loss was minimal by the increase in the specific resistance when the Cr content in the Fe alloy powder was from 6 to 8 mass %. When the Cr content exceeded 8 mass %, both the magnetic flux density and the magnetic permeability were decreased, so that hysteresis loss was increased. As a result, the iron loss was increased. This variation in the iron loss was within the desired value thereof.

(6) The corrosion resistance was the most greatly influenced by the Cr content in the Fe alloy powder. In the samples 01 and 02 including less than 3 mass % of Cr, the corrosion was generated on the entire surfaces thereof. In the sample 03 including 3 mass % of Cr, the corrosion was slightly generated, but most of the surface thereof was good. In the samples including 4 mass % or more of Cr, the corrosion was not generated, and the surfaces thereof were good.

As described above, when the Cr content in the Fe alloy powder was 3 mass % or more, the corrosion resistant effect on the generation of corrosion was confirmed. In particular, when the Cr content was 4 mass % or more, the corrosion resistant effect was better. However, when the Cr content exceeded 8 mass %, the magnetic flux density and the magnetic permeability were greatly decreased. Therefore, when the Cr content was from 3 to 8 mass % and was more preferably 4 to 8 mass %, the wear amount, the magnetic properties, and the corrosion resistance were good.

Embodiment 2

An Fe alloy powder having a composition shown in Table 3 was mixed with an Si powder at a rate shown in Table 3, so that a mixed powder was prepared. Samples 08 to 13 were produced and evaluated in the same condition as that in the embodiment 1 by using the mixed powder. These evaluation results are shown with those of the sample 05 of the embodiment 1 in Table 4. In addition, magnetic permeabilities were measured at temperatures of −40° C. and 200° C. The magnetic permeability of each sample measured at a room temperature (20° C.) was converted into 100 as a standard index, and the magnetic permeabilities of each sample measured at temperatures of −40° C. and 200° C. were converted into indexes thereof based on the standard index (=100). The indexes of the magnetic permeabilities of each sample at temperatures of −40° C. and 200° C. are shown with those of the sample 05 of the embodiment 1 as evaluation results in Table 5.

TABLE 3

| Sample No. | Mixing Ratio mass % | | | | | | Overall Composition mass % | | |
|---|---|---|---|---|---|---|---|---|---|
| | Fe Alloy Powder | | | | Si Powder | | | | |
| | | Powder Composition Mass % | | | | Average Diameter | | | |
| | | Fe | Cr | Si | | μm | Fe | Cr | Si |
| 08 | Balance | Balance | 6.00 | 1.00 | — | 10.00 | Balance | 5.97 | 1.00 |
| 09 | Balance | Balance | 6.00 | 1.50 | — | 10.00 | Balance | 6.00 | 1.50 |
| 10 | Balance | Balance | 6.00 | 1.50 | 0.50 | 10.00 | Balance | 5.97 | 1.99 |
| 11 | Balance | Balance | 6.00 | 2.00 | — | 10.00 | Balance | 6.00 | 2.00 |
| 05 | Balance | Balance | 6.00 | 3.00 | 0.50 | 10.00 | Balance | 5.97 | 3.49 |
| 12 | Balance | Balance | 6.00 | 3.50 | 0.50 | 10.00 | Balance | 5.97 | 3.98 |
| 13 | Balance | Balance | 6.00 | 4.00 | 0.50 | 10.00 | Balance | 5.97 | 4.48 |

TABLE 4

| Sample No. | Evaluation Item | | | | | | | |
|---|---|---|---|---|---|---|---|---|
| | Hardness HRB | Wear | | DC magnetic properties | | AC magnetic properties | Electrical Property Specific | Corrosion Resistance |
| | | Amount μm | Density $Mg/m^3$ | $B_{2000}$ T | $\mu_m$ | W(0.1 T/1 kHz) W/kg | Resistance p μΩcm | |
| 08 | 65 | 10 | 7.42 | 1.43 | 3500 | 18.3 | 35 | Good |
| 09 | 70 | 5 | 7.36 | 1.39 | 3500 | 10.3 | 60 | Good |
| 10 | 70 | 5 | 7.35 | 1.35 | 3500 | 9.9 | 87 | Good |
| 11 | 82 | 4 | 7.33 | 1.33 | 3500 | 9.5 | 99 | Good |
| 05 | 90 | 2 | 7.30 | 1.30 | 3500 | 8.3 | 120 | Good |
| 12 | 95 | 2 | 7.15 | 1.20 | 3300 | 9.6 | 131 | Good |
| 13 | 105 | 1 | 7.05 | 1.10 | 2900 | 10.8 | 142 | Good |

TABLE 5

| Sample No. | Change in Maxim Magnetic Permeability By Temperature Change | | | |
|---|---|---|---|---|
| | Room Temperature | −40° C. | 200° C. | Width of Variation |
| 08 | 100 | 86 | 116 | 30% |
| 09 | 100 | 92 | 109 | 17% |
| 10 | 100 | 93 | 108 | 15% |
| 11 | 100 | 94 | 106 | 12% |
| 05 | 100 | 95 | 105 | 10% |
| 12 | 100 | 96 | 105 | 9% |
| 13 | 100 | 97 | 103 | 6% |

As shown in Tables 3 and 5, the influences of the Si content in overall composition and the Si content in the Fe alloy powder are described below.

(1) As the Si content in overall composition and the Si content in the Fe alloy powder were increased, the hardness increased and the wear amount greatly decreased in accordance with the increase in the hardness. It should be noted that in the sample 08 including less than 1.5 mass % of Si, the hardness was low and the wear was 10 μm which was large.

(2) As the Si content in the Fe alloy powder was increased, the hardness of the Fe alloy powder increased, so that the density decreased in accordance with decrease in compressibility. Due to this, the magnetic flux density decreased. In the sample 12 in which the Fe alloy powder included more than 3.5 mass % of Si, the magnetic flux density greatly decreased, and was smaller than the desired magnetic flux density of 1.2 T.

(3) As the Si content in overall composition and the Si content in the Fe alloy powder were increased, the magnetic permeability slightly decreased, but still had a good value in the desired magnetic permeability.

(4) As the content in overall composition and the Si content in the Fe alloy powder were increased, the specific resistance was greatly increased.

(5) When the Si content in overall composition was less than 1.5 mass %, the iron loss was larger than the desired iron loss of 10 W/kg. However, as the Si content in the Fe alloy powder was increased and the amount of the Si powder was increased, the specific resistance increased, so that eddy current loss decreased and the iron loss decreased. When the Si content in the Fe alloy powder exceeded 3 mass %, the occupied volume rate of Fe decreased, and the magnetic flux density and the magnetic permeability decreased. Due to this, hysteresis loss increased, so that the iron loss increased. When the Si content in the Fe alloy powder exceeded 3.5 mass %, the iron loss was larger than the desired iron loss of 10 W/kg.

(6) In the samples, the corrosion resistances were not influenced by the Si content in overall composition, and they were "good".

In addition, as shown in Tables 3 and 5, when the environmental temperature was changed from −40° C. to 200° C., 2 mass % of Si was added to the sample, so that the change in the magnetic permeability (width of variation in the magnetic permeability) was reduced by half. As the Si content in overall composition was further increased, the width of variation in the magnetic permeability was smaller. Therefore, the Si content in overall composition was 2 mass % or more in order to reduce the influence of the environmental temperature on the magnetic properties, so that the width of variation in the magnetic permeability could be reduced by half by adding 2 mass % or more of Si.

In comparison with the samples 10 and 11, the samples 10 and 11 had the same total compositions and had the same properties without depending on adding method of Si. Therefore, it was confirmed that only the Fe alloy powder may be used and the mixed powder in which the Fe alloy powder was mixed with the Si powder may be used.

As described above, it was confirmed that when the Si content in the Fe alloy powder was from 1.5 to 3.5 mass %, the wear amount was small, the DC magnetic properties having a high magnetic flux density and a high magnetic permeability were good, and the AC magnetic property having a low iron loss and was good. It was confirmed that the variation in magnetic properties was small in the case in which the Si content in the Fe alloy powder was 1.5 mass % or more even when the environmental temperature changed. It was confirmed that only Fe alloy powder may be used.

Embodiment 3

The Fe alloy powders used in the sample 05 of the embodiment 1 was mixed with Si powders at various rates shown in Table 6, so that mixed powders were prepared. Samples 14 to 21 were produced and evaluated in the same conditions as in the embodiment 1 by using the mixed powders. These evaluation results are shown with those of the sample 05 of the embodiment 1 in Table 7.

TABLE 6

| Sample | Mixing Ratio mass % | | | | | | Overall Composition mass % | | |
|---|---|---|---|---|---|---|---|---|---|
| | Fe Alloy Powder | | | | Si Powder | | | | |
| | | Powder Composition Mass % | | | | Average Diameter | | | |
| No. | | Fe | Cr | Si | | μm | Fe | Cr | Si |
| 14 | Balance | Balance | 6.00 | 3.00 | 0.10 | 10.00 | Balance | 5.99 | 3.10 |
| 05 | Balance | Balance | 6.00 | 3.00 | 0.50 | 10.00 | Balance | 5.97 | 3.49 |
| 15 | Balance | Balance | 6.00 | 3.00 | 1.00 | 10.00 | Balance | 5.94 | 3.97 |
| 16 | Balance | Balance | 6.00 | 3.00 | 1.50 | 10.00 | Balance | 5.91 | 4.46 |
| 17 | Balance | Balance | 6.00 | 3.00 | 2.00 | 10.00 | Balance | 5.88 | 4.94 |
| 18 | Balance | Balance | 6.00 | 3.00 | 2.50 | 10.00 | Balance | 5.85 | 5.43 |
| 19 | Balance | Balance | 6.00 | 3.00 | 3.00 | 10.00 | Balance | 5.82 | 5.91 |
| 20 | Balance | Balance | 6.00 | 3.00 | 3.50 | 10.00 | Balance | 5.79 | 6.40 |
| 21 | Balance | Balance | 6.00 | 3.00 | 4.00 | 10.00 | Balance | 5.76 | 6.88 |

TABLE 7

| Sample No. | Evaluation Item | | | | | | | |
|---|---|---|---|---|---|---|---|---|
| | Hardness HRB | Wear | | DC magnetic properties | | AC magnetic properties | Electrical Property Specific | Corrosion Resistance |
| | | Amount μm | Density $Mg/m^3$ | $B_{2000}$ T | $\mu_m$ | W(0.1 T/1 kHz) W/kg | Resistance p μΩcm | |
| 14 | 88 | 3 | 7.33 | 1.33 | 3300 | 8.4 | 114 | Good |
| 05 | 90 | 2 | 7.30 | 1.30 | 3500 | 8.3 | 120 | Good |
| 15 | 95 | 2 | 7.26 | 1.28 | 3600 | 8.2 | 130 | Good |
| 16 | 105 | 1 | 7.22 | 1.25 | 4000 | 8.0 | 139 | Good |
| 17 | 108 | 1 | 7.19 | 1.23 | 4500 | 8.2 | 141 | Good |
| 18 | 110 | 1 | 7.16 | 1.22 | 4600 | 8.3 | 145 | Good |
| 19 | 113 | 1 | 7.13 | 1.21 | 4700 | 8.7 | 151 | Good |
| 20 | 115 | 1 | 7.10 | 1.20 | 6000 | 8.9 | 156 | Good |
| 21 | 120 | 1 | 7.04 | 1.10 | 4200 | 10.4 | 160 | Good |

As shown in Tables 6 and 7, the influence of the added amount of the fine Si powder is described below.

(1) As the added amount of the fine Si powder was larger than 0.1 mass %, the hardness was improved and the wear amount was reduced.

(2) As the added Si content was increased, the density decreased and the magnetic flux density decreased. In particular, in the sample 21 in which 3.5 mass % or more of the fine Si powder was added to the mixed powder, the magnetic flux density greatly decreased.

(3) As the added amount of the fine Si powder was increased, the magnetic permeability increased. In contrast, when the added amount of the fine Si powder exceeded 3.5 mass %, the magnetic permeability greatly decreased.

(4) As the magnetic permeability increased, the specific resistance was improved.

(5) When the added amount of the fine Si powder was 1.5 mass % or less, the iron loss was reduced in accordance with the improvement in the specific resistance. When the added amount of the fine Si powder exceeded 1.5 mass %, the magnetic flux decreased, so that the iron loss increased. When the added amount of the fine Si powder exceeded 3.5 mass %, the magnetic flux greatly decreased, so that the iron loss greatly increased.

(6) In the samples, the corrosion resistances were not influenced by the added amount of the fine Si powder, and were "good".

Therefore, it was confirmed that when the added amount of the fine Si powder was from 0.1 to 3.5 mass %, the desired wear amount, the desired magnetic properties and the desired corrosion resistance can be obtained.

Embodiment 4

The Fe alloy powders used in the sample 05 of the embodiment 1 was mixed with Si powders having particle diameters different from each other shown in Table 8, so that mixed powders were prepared. Samples 22 to 25 were produced and evaluated in the same condition as that in the embodiment 1 by using the mixed powders. The evaluation results are shown with those of the sample 05 of the embodiment 1 in Table 9.

TABLE 8

| Sample No. | Mixing Ratio mass % | | | | | | | | |
|---|---|---|---|---|---|---|---|---|---|
| | Fe Alloy Powder | | | | Si Powder | | | | |
| | | Powder Composition mass % | | | | Average Diameter | Overall Composition mass % | | |
| | | Fe | Cr | Si | | μm | Fe | Cr | Si |
| 22 | Balance | Balance | 6.00 | 3.00 | 0.50 | 1.00 | Balance | 5.97 | 3.49 |
| 05 | Balance | Balance | 6.00 | 3.00 | 0.50 | 10.00 | Balance | 5.97 | 3.49 |
| 23 | Balance | Balance | 6.00 | 3.00 | 0.50 | 25.00 | Balance | 5.97 | 3.49 |
| 24 | Balance | Balance | 6.00 | 3.00 | 0.50 | 45.00 | Balance | 5.97 | 3.49 |
| 25 | Balance | Balance | 6.00 | 3.00 | 0.50 | 75.00 | Balance | 5.97 | 3.49 |

TABLE 9

| Sample No. | Evaluation Item | | | | | | | |
|---|---|---|---|---|---|---|---|---|
| | Hardness HRB | Wear | | DC Magnetic properties | | AC Magnetic properties | Electrical Property Specific | Corrosion Resistance |
| | | Amount μm | Density $Mg/m^3$ | $B_{2000}$ T | $\mu_m$ | W(0.1 T/1 kHz) W/kg | Resistance p μΩcm | |
| 22 | 91 | 2 | 7.30 | 1.30 | 3600 | 8.3 | 122 | Good |
| 05 | 90 | 2 | 7.30 | 1.30 | 3500 | 8.3 | 120 | Good |
| 23 | 89 | 2 | 7.30 | 1.30 | 3400 | 8.5 | 118 | Good |
| 24 | 88 | 3 | 7.28 | 1.28 | 3000 | 8.8 | 117 | Good |
| 25 | 80 | 6 | 7.20 | 1.18 | 2200 | 10.7 | 117 | Good |

Tables 8 and 9 show the evaluation results for examining the influences of the average diameter of the added Si powder, and the following findings were obtained by the examination.

(1) The smaller the average particle diameter, the higher the hardness, so that the wear amount was reduced. However, in the sample 25 having an average diameter of more than 45 μm, the wear amount exceeded 5 μm.

(2) When the average diameter of the Si powder was 25 μm or less, the density was constant. When the average diameter of the Si powder exceeded 25 μm, the density decreased. This is because coarse particles of Si are not uniformly diffused. Due to this, when the average diameter of the Si powder was 25 μm or less, the magnetic flux density was constant in the same manner as that of the density. When the average diameter of the Si powder exceeded 25 μm, the density decreased, and the magnetic flux density decreased in the same manner as that of the density. When the average diameter of the Si powder exceeded 45 μm, the decrease in the magnetic flux density was great and the magnetic flux density was less than 1.2 T.

(3) The larger the average diameter of the Si powder, the lower the magnetic permeability. In the sample 25 having an average diameter of the Si powder, the magnetic permeability greatly decreased. This is because coarse particles of Si are not uniformly diffused and growth of crystal grains is thereby not uniform.

(4) The specific resistance was not significantly influenced on the average diameter of the Si powder, and it was constant.

(5) The iron loss is the sum of eddy current loss and hysteresis loss. Due to this, in a region in which the Si powder was small and was uniformly diffused, crystal grains were uniformly grown, so that the magnetic permeability was high, the hysteresis loss was reduced, and the iron loss was reduced. The larger the average diameter of the Si powder, the lower the magnetic permeability, so that the hysteresis loss was large. Due to these, when the average diameter of the Si powder was 10 μm, the iron loss, which is the sum of eddy current loss and hysteresis loss, was minimal. The larger the average diameter of the Si powder, the higher the magnetic permeability.

(6) In the samples, the corrosion resistances were not influenced by the average diameter of the Si powder, and they were "good".

As described above, the smaller the average particle diameter of the Si powder, the better the Si powder. However, when the average particle diameter of the Si powder exceeded 45 μm, the magnetic permeability and the magnetic flux density greatly decreased. Therefore, it was confirmed that the average particle diameter of the Si powder is desirably 45 μm or less.

Embodiment 5

The mixing of the powders for obtaining the mixed powder of the sample 05 of the embodiment 1 used methods B to D in which the fine Si powder was coated around the Fe alloy powder as shown in Table 10. Samples 26 to 28 were obtained by using the same production processes as those used for the sample 05 of the embodiment 1, except for the mixing method of the powders. A method A which is shown in Table 10 is a simple dry type mixing method. The method B is a method in which an Fe alloy powder is immersed and flowed into a dispersion liquid in which an Si powder is dispersed in ethanol and the ethanol is dried by volatilizing. The method C is a method in which a dispersion liquid in which the Si powder is dispersed in ethanol is sprayed and flowed to an Fe alloy powder and the ethanol is dried by volatilizing. The method D is a method in which 0.25 mass % of PVP as a binder is added into the dispersion liquid in the method C. The changes in properties of the samples are shown in Table 11.

TABLE 10

| Sample No. | Mixing Method | |
|---|---|---|
| 05 | Method A | Dry Type Mixing |
| 26 | Method B | An Fe alloy powder is immersed ed into a dispersion liquid in which an Si powder is dispersed in ethanol, and the ethanol is dried by volatilizing. |
| 27 | Method C | A dispersion liquid in which the Si powder is dispersed in ethanol is sprayed onto an Fe alloy powder, and the ethanol is dried by volatilizing. |
| 28 | Method D | 0.25 mass % of PVP as a binder is added into the dispersion liquid in the method C. |

TABLE 11

| | Evaluation Item | | | | | | | |
|---|---|---|---|---|---|---|---|---|
| | | Wear | | DC Magnetic properties | | AC Magnetic properties | Electrical Property Specific | |
| Sample No. | Hardness HRB | Amount μm | Density $Mg/m^3$ | $B_{2000}$ T | $\mu_m$ | W(0.1 T/1 kHz) W/kg | Resistance p μΩcm | Corrosion Resistance |
| 05 | 90 | 2 | 7.30 | 1.30 | 3500 | 8.3 | 120 | Good |
| 26 | 91 | 2 | 7.31 | 1.35 | 3800 | 8.2 | 120 | Good |
| 27 | 91 | 2 | 7.33 | 1.37 | 3900 | 8.0 | 120 | Good |
| 28 | 91 | 2 | 7.36 | 1.40 | 4100 | 7.9 | 120 | Good |

As shown in Tables 10 and 11, the dispersion of the fine Si powder became more uniform in the order of the mixing feature by the method A, the mixing feature by the method B, the mixing feature by the method C, and the mixed feature by the method D. Due to this, the density increased, and the magnetic flux density was improved. Since Si was dispersed more uniformly, the crystal grains were grown more uniformly, so that the magnetic permeability was improved, the hysteresis loss was reduced, and the iron loss was reduced.

As examined in the embodiments 1 to 4, when the mixing of the fine Si powder was the simple dry type mixing, the magnetic properties were sufficiently improved. Furthermore, in the embodiment 5, the magnetic property was more satisfactorily improved by changing the mixing method to the wet type mixing.

Embodiment 6

The Fe alloy powders used in the embodiments 1 to 5 were powders annealed at a temperature of 600° C. In the embodiment 6, the annealing temperature of the Fe alloy powder used for the raw powder of the sample 05 of the embodiment 1 was varied as shown in Table 12, and samples 29 to 34 were produced and evaluated. The evaluation results are shown together with those of the sample 05 of the embodiment 1 in Table 12.

TABLE 12

| | Sintering | Evaluation Item | | | | | | | | |
|---|---|---|---|---|---|---|---|---|---|---|
| | | | | Wear | | DC Magnetic Density Mg/m$^3$ | | AC Magnetic properties | Electrical property properties | Specific |
| Sample No. | Temperature ° C. | Hardness HRB | Amount μm | Green Compact | Sintered Compact | $B_{2000}$ T | $\mu_m$ | W(0.1 T/1 kHz) W/kg | Resistance p μΩcm | Corrosion Resistance |
| 29 | 400 | 95 | 10 | 6.30 | 7.00 | 1.10 | 2500 | 9.3 | 130 | Bad |
| 30 | 500 | 93 | 5 | 6.40 | 7.10 | 1.15 | 2600 | 8.8 | 125 | Bad |
| 05 | 600 | 90 | 2 | 6.70 | 7.30 | 1.30 | 3500 | 8.3 | 120 | Good |
| 31 | 700 | 85 | 2 | 6.80 | 7.35 | 1.38 | 4000 | 8.2 | 115 | Good |
| 32 | 750 | 83 | 2 | 6.90 | 7.40 | 1.40 | 4500 | 8.1 | 113 | Good |
| 33 | 800 | 80 | 2 | 7.00 | 7.45 | 1.42 | 4800 | 8.0 | 110 | Good |
| 34 | 850 | 90 | 2 | 6.70 | 7.25 | 1.25 | 3000 | 8.8 | 123 | Good |

The following findings are given in Table 12.

(1) As the annealing temperature increased, strain stored in the Fe alloy powder was removed more, so that the compressibility was improved. As a result, the density of the green compact increased, so that the density of the sintered compact increased. In the samples 29 and 30 for which the annealing temperature was less than 600° C., the effect of strain removal was small, so that the compressibility was low. Due to this, the density of the green compact was insufficient. On the other hand, in the sample 34 for which the annealing temperature was less than 850° C., the annealing temperature was too high, so that particles of the Fe alloy powder were bonded by diffusion. Due to this, when the bonded particles of the Fe alloy powder were mechanically broken and were used for the above evaluation tests, strain formed by machining in the Fe alloy powder was stored, so that the compressibility was low. Due to this, the density of the green compact decreased, so that the density of the sintered compact decreased.

(2) As the density of sintered compact increased, the hardness was increased, so that the wear amount was reduced. In the samples 29 and 30 for which the annealing temperature was less than 600° C., the density of the sintered compact was insufficient, and the hardness was low, so that the wear amount increased.

(3) As the annealing temperature was higher, the magnetic flux density and the magnetic permeability were higher in accordance with the increase in the density of the sintered compact.

(4) The specific resistance and the iron loss were not almost influenced by the annealing temperature and were approximately constant.

(5) In the samples for which the annealing temperature was 600° C. or more, the corrosion resistance was good. However, the lower the annealing temperature, the lower the density and the worse the corrosion resistance.

As described above, when the annealing temperature was 600° C., the sample exhibited good properties. As the annealing temperature was more than 600° C., the magnetic properties (in particular, the magnetic flux density) were more improved. However, when the annealing temperature exceeded 800° C., the particles of the Fe alloy powder were bonded by diffusion, so that it was troublesome to then break the bonded particles of the Fe alloy powder. In addition, the strain was stored in the Fe alloy powder in spite of the breaking thereof, so that the properties of the sample were deteriorated.

INDUSTRIAL APPLICABILITY

According to the production method for a soft magnetic sintered member, Si uniformly disperses into the Fe alloy powder, whereby distribution of the alloy elements is uniform. Since expensive fine Fe alloy powder is not used, a granulation step is not required and production cost can be low. Furthermore, magnetic properties of the member are stable in practical environmental temperatures. Therefore, the present invention can produce soft magnetic sintered member such as plungers for solenoid valves in electronic fuel injection devices for automobiles, hydraulic apparatuses, and various kinds of machining apparatuses, and members such as various kinds of actuators required to have corrosion resistance and strength as well as alternating current magnetic properties.

The invention claimed is:

1. A production method for a soft magnetic sintered member, the method comprising:

preparing an Fe alloy powder having an average particle size of 75 to 150 μm, the Fe alloy powder consisting of 3 to 7 mass % of Cr, 1.5 to 3.5 mass % of Si, and the balance of Fe and inevitable impurities;

compacting the Fe alloy powder into a green compact having a predetermined shape; and sintering the green compact, wherein the Fe alloy powder is annealed at a temperature of 600 to 800° C.

2. A production method for a soft magnetic sintered member, the method comprising:

preparing an Si powder having an average particle size of 1 to 45 μm and an Fe alloy powder having an average particle size of 75 to 150 μm, the Fe alloy powder consisting of 3 to 7 mass % of Cr, 1.5 to 3.5 mass % of Si, and balance of Fe and inevitable impurities;

mixing of the Si powder and the Fe alloy powder to obtain a mixed powder, whereby an amount of the Si powder in the mixed powder is 0.1 to 3.5 mass %;

compacting the mixed powder into a green compact having a predetermined shape; and sintering the green compact.

3. The production method for a soft magnetic sintered member according to claim 2, wherein the Fe alloy powder is annealed at a temperature of 600 to 800° C.

4. The production method for a soft magnetic sintered member according to claim 2, wherein the Fe powder is coated with the Si powder via a binder.

5. The production method for a soft magnetic sintered member according to claim 2, wherein the mixed powder is obtained by immersing the Fe alloy powder into a dispersion liquid in which the Si powder is dispersed in water or ethanol, or spraying the dispersion liquid onto the Fe alloy powder, and then drying the Fe alloy powder.

6. The production method for a soft magnetic sintered member according to claim 5, wherein a binder is mixed with the dispersion liquid at a rate of 1 mass % or less with respect to 100 mass % of the mixed powder.

* * * * *